US007114776B1

(12) United States Patent
Wiltberger

(10) Patent No.: US 7,114,776 B1
(45) Date of Patent: Oct. 3, 2006

(54) LUMBAR SUPPORT CUSHION

(76) Inventor: Charles M. Wiltberger, 4850 Lafonda Dr., Las Vegas, NV (US) 89121

( * ) Notice: Subject to any disclaimer, the term of this patent is extended or adjusted under 35 U.S.C. 154(b) by 0 days.

(21) Appl. No.: 11/140,171

(22) Filed: May 31, 2005

(51) Int. Cl.
*A47C 7/02* (2006.01)

(52) U.S. Cl. ..... 297/284.5; 297/229; 297/284.7; 297/452.26

(58) Field of Classification Search ..... 297/229, 297/284.5, 284.7, 452.23, 452.26
See application file for complete search history.

(56) References Cited

U.S. PATENT DOCUMENTS 2,815,798 A * 12/1957 Lohans ..... 297/230.12
2,855,986 A * 10/1958 Engelen, Sr. ..... 297/382
3,112,956 A * 12/1963 Schick et al. ..... 297/219.1
4,912,788 A * 4/1990 Lonardo ..... 297/230.13
5,452,940 A * 9/1995 Maier ..... 297/452.32
5,702,153 A * 12/1997 Pliska ..... 297/256.16
5,868,463 A * 2/1999 MacKenzie et al. ... 297/228.12
6,079,784 A * 6/2000 Peachey ..... 297/284.5
6,299,248 B1 * 10/2001 Gennaro et al. ..... 297/230.13

* cited by examiner

*Primary Examiner*—Peter R. Brown
(74) *Attorney, Agent, or Firm*—Harry M. Weiss; Weiss & Moy, P.C.

(57) ABSTRACT

A lumbar support cushion consists of a seat portion and a back portion, foldably joined along a crease positioned therebetween. An opening extends in a continuous manner upward into the back portion, and downward into the seat portion. The opening may have an oval shape. In one embodiment, a support member is provided, and is positioned across the front of the back portion. The position of the support member along the back portion may be made adjustable, for example by the use of mating hook and loop material on the support member and a rear portion of the back portion.

1 Claim, 2 Drawing Sheets

LUMBAR SUPPORT CUSHION

RELATED APPLICATIONS

This non-provisional application claims priority from design patent application Ser. No. 29/201,814, filed on Mar. 22, 2004, and from design patent application Ser. No. 29/210,871, filed on Aug. 9, 2004

FIELD OF THE INVENTION

This invention relates generally to lumbar support devices and, more particularly, to a lumbar support cushion adapted to be positioned over an existing seat.

BACKGROUND OF THE INVENTION

Millions of Americans suffer from back problems and associated pain. Often, back pain originates with problems are located in the lumbar region of the spine.

Back pain sufferers are commonly advised to take care in selecting a seat that provides sufficient lumbar support, and that is otherwise configured in an ergonomically sound manner. This may require the purchase of a specialized chair providing such support. In some instances, persons may wish to utilize an existing chair, while inserting against a back portion thereof a lumbar support—to be interposed between the spine of the user and the back support of the existing seat.

A need exists for a cushion that may be placed over both the seat and back portions of an existing chair, and that provides lumbar support in a sound and efficient manner. The present invention satisfies these needs and provides other, related, advantages.

SUMMARY OF THE INVENTION

In accordance with one embodiment of the present invention, a lumbar support cushion is provided. The lumbar support cushion comprises, in combination: a seat cushion having a seat portion and a back portion, wherein the seat portion and the back portion are joined along a foldable crease; and an opening extending partially upward into the back portion and partially downward into the seat portion.

In accordance with another embodiment of the present invention, a lumbar support cushion is provided. The lumbar support cushion comprises, in combination: a seat cushion having a seat portion and a back portion, wherein the seat portion and the back portion are joined along a foldable crease; an opening extending partially upward into the back portion and partially downward into the seat portion; wherein the opening has an oval configuration; and a support member coupled across a front surface of the back portion.

In accordance with a further embodiment of the present invention, a lumbar support cushion is provided. The lumbar support cushion comprises, in combination: a seat cushion having a seat portion and a back portion, wherein the seat portion and the back portion are joined along a foldable crease; an opening extending partially upward into the back portion and partially downward into the seat portion; wherein the opening has an oval configuration; a support member coupled across a front surface of the back portion; wherein the support member is removably coupled across the front surface; wherein a position of the support member along the front surface of the back portion is adjustable; wherein the support member comprises a main support portion having a first end and a second end, a fastening tab located at each of the first end and the second end of the main support portion; fastening means facilitating removable coupling of the first end and the second end to a rear surface of the back portion; and one of hook and loop material on each of the fastening tabs, and a corresponding other of hook or loop material on the rear surface of the back portion.

DETAILED DESCRIPTION OF THE PREFERRED EMBODIMENTS

Figure 5:
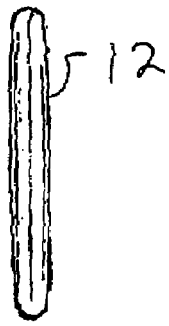
FIG. 5 is a side view of the lumbar seat cushion of FIG. 1, in a fully-folded configuration.

Referring first to FIGS. 1–5, a seat cushion 10 consistent with an embodiment of the present invention is shown. The seat cushion 10 preferably comprises a back portion 12 and a seat portion 14, foldable about crease 16. (As shown in FIG. 5, preferably, the back portion 12 may be fully folded relative to the seat portion 14 so that the one fully contacts the other, facilitating storage, transport, and packaging.)

Figure 1:
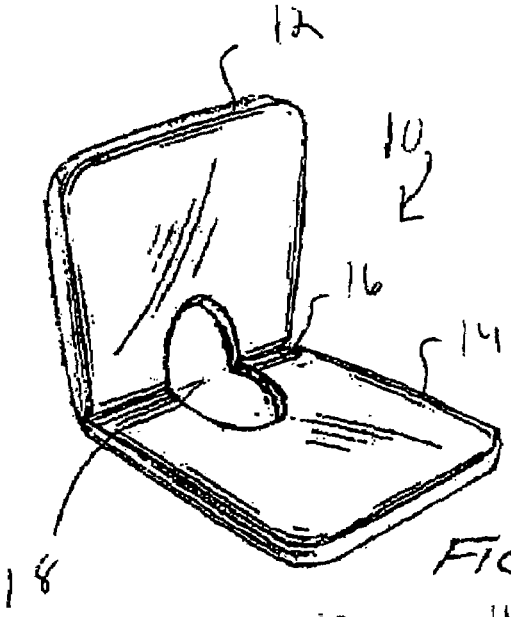
FIG. 1 is a perspective view of a lumbar seat cushion consistent with an embodiment of the present invention.
Figure 2:
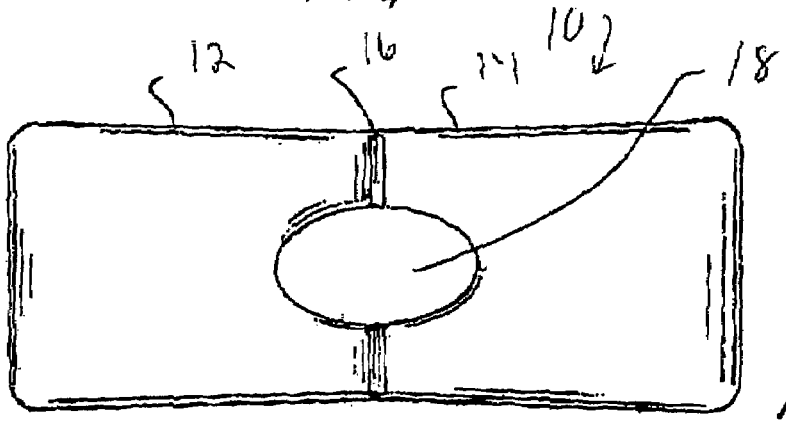
FIG. 2 is a top view of the lumbar seat cushion of FIG. 1.
Figure 3:
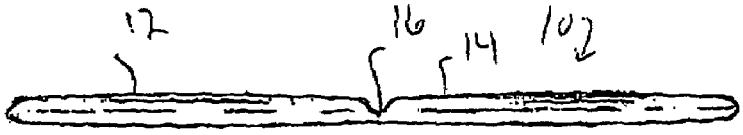
FIG. 3 is a side view of the lumbar seat cushion of FIG. 1.
Figure 4:
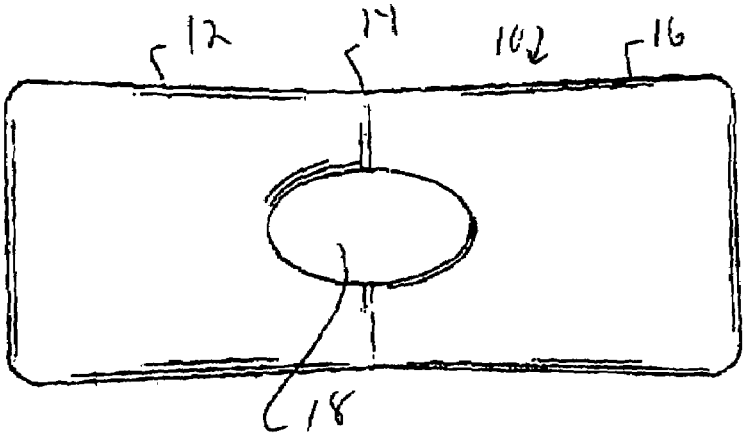
FIG. 4 is a bottom view of the lumbar seat cushion of FIG. 1.

Referring specifically to FIGS. 1, 2 and 4, an opening 18 is provided, which extends partially upward into back portion 12 and partially downward into seat portion 14. The opening 18 is continuous. As shown in these figures, it may have a generally oval configuration.

A person utilizing seat cushion 10 will want to place the seat cushion 10 atop an existing chair (not shown). The chair may be for indoor or outdoor use, and it is regarded as a particular benefit of the present invention that it may be utilized with outdoor furniture as well as indoor furniture. The user will want to sit with the back firmly against the back portion 12, so that the lumbar region of the back is against the portion of opening 18 that extends into the back portion 12, with a portion of the buttocks positioned over the portion of the opening 18 that extends into the seat portion 14.

Referring now to FIGS. 6–9, a seat cushion 20 consistent with another embodiment of the present invention is shown. The seat cushion 20 preferably comprises a back portion 22 and a seat portion 24, foldable about crease 26.

Figure 6:
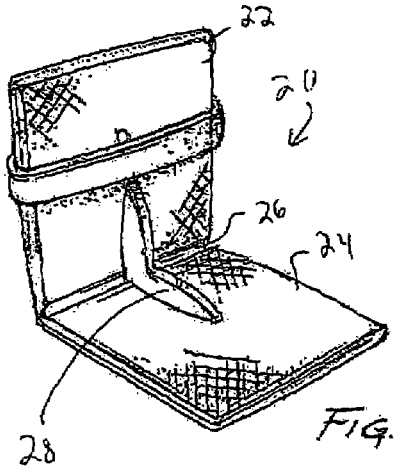
FIG. 6 is a perspective view of a lumbar seat cushion consistent with an embodiment of the present invention.
Figure 10:
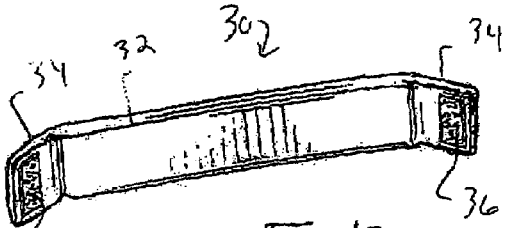
FIG. 10 is a perspective view of a support member portion of side view of the lumbar seat cushion of FIG. 6.
Figure 7:
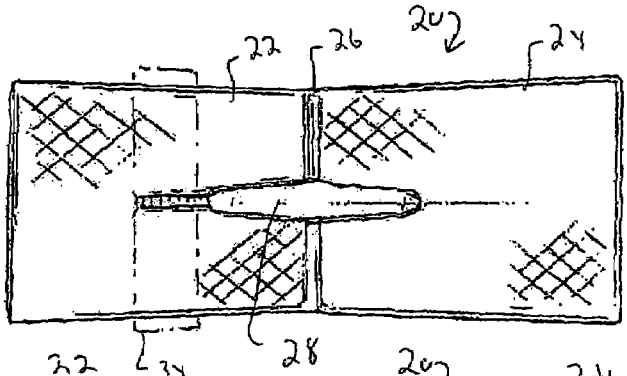
FIG. 7 is a top view of the lumbar seat cushion of FIG. 6.
Figure 8:
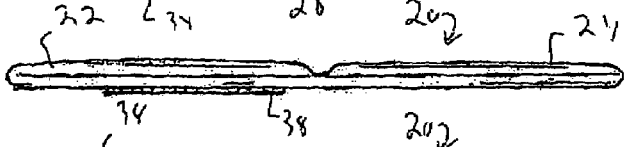
FIG. 8 is a side view of the lumbar seat cushion of FIG. 6.
Figure 9:
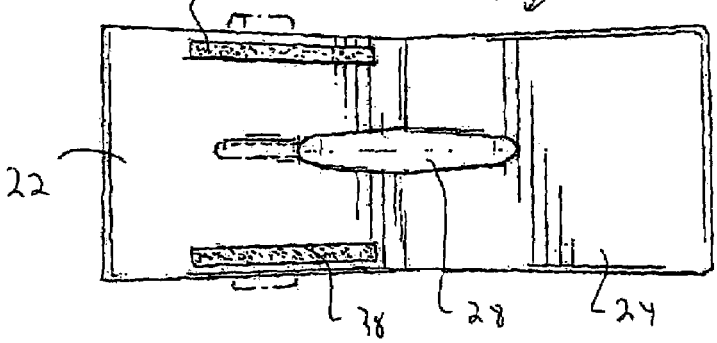
FIG. 9 is a bottom view of the lumbar seat cushion of FIG. 6.

Referring specifically to FIGS. 6, 7 and 9, an opening 28 is provided, which extends partially upward into back portion 22 and partially downward into seat portion 24. The opening 28 is continuous. As shown in these figures, it may have a generally oval configuration.

Referring now to each of FIGS. 6–10, in one embodiment, a lumbar support member 30 is additionally provided. The support member 30 preferably comprises a main support portion 32, and fastening tabs 34. Each of fastening tabs 34 has a fastening means 36 thereon, to facilitate removable and adjustable coupling to back portion 22. In one embodiment, the fastening means 36 is hook material, which may be removably coupled along a mating strip of loop material 38 located on a rear portion of back portion 22. (It should be noted that other fastening means could also be provided, such as, for example, a female snap portion on the fastening tab 34 and a series of mating male snap portions along a rear portion of back portion 22.)

To provide enhanced lumbar support, it may be preferred to attach support member 30 to back portion 22, by securing the fastening means 36 to the loop material 38. During such attachment step, it is desired to position the support member 30 at a height relative to a back of a user that provides optimal comfort and/or relief to the user. The adjustability of the height of the support member 30 permits a user to experiment with different heights, permits more than one user to utilize a particular pad 20, and permits a one-size-fits-all marketing of the seat cushion 20.

Other than the positioning of the support member 30, the use of the seat cushion 20 should proceed, as described above with respect to the seat cushion 10.

While the invention has been particularly shown and described with reference to preferred embodiments thereof, it will be understood by those skilled in the art that the foregoing and other changes in form and details may be made therein without departing from the spirit and scope of the invention. For example, the use of hook and loop material for fastening means 36 and loop material 38 may be reversed. It may also be desired to position loop material 38 along a front surface of the back portion 22, and to position the fastening means 36 on an underside of the support member 30.

I claim:

1. A lumbar support cushion comprising in combination:

a portable seat cushion having a seat portion and a back portion, wherein the seat portion and the back portion are joined along a foldable crease; and an opening extending partially upward into the back portion and partially downward into the seat portion, further comprising a support member releasably and adjustably coupled to and across a front surface of said back portion; the support member is attachably and removably coupled to and across the front surface; a position of the support member vertically along the front surface of the back portion is adjustable; the support member comprises a main support portion having a first end and a second end and a vertical elongated quick attach-quick release fastening tab extending substantially across a width of the support member is located at each of the first end and the second end of the main support portion; further comprising quick attach-quick release fastening means consisting of two spaced apart vertical elongated strips located on a back surface of said back portion for facilitating removable coupling of the first end and the second end of the support member to the rear surface of the back portion; further comprising one of hook and loop material on each of the fastening tabs, and a corresponding other of hook or loop material on each of the two spaced apart vertical elongated strips that are located on the rear surface of the back portion thereby permitting both more secure attachment of the support member to the back portion and angled attachment of the support member across the front surface of the cushion.

* * * * *